United States Patent [19]

Maddox

[11] 4,002,462

[45] Jan. 11, 1977

[54] ORE BENEFICIATION METHOD AND APPARATUS

[76] Inventor: Chesford M. Maddox, Box 213, Clifton, Colo. 81520

[22] Filed: Dec. 31, 1974

[21] Appl. No.: 537,739

[52] U.S. Cl. ..... 75/1 R; 241/20

[51] Int. Cl.[2] ..... C22B 1/00

[58] Field of Search ..... 75/1; 23/274; 210/155–161; 241/20, 24

[56] References Cited

UNITED STATES PATENTS 3,485,487 12/1969 Bennett ..... 75/1

*Primary Examiner*—Peter D. Rosenberg
*Attorney, Agent, or Firm*—C. B. Messenger

[57] ABSTRACT

A dry milling process for separating a mineral values bearing component from the sand grains or gangue materials of sedimentary formations. The ores are crushed, ground and screened until the bulk of material is of a size corresponding to or slightly larger than the predominant size of the sand grain particles embedded in the deposit. After or before complete sizing the ore charge may be heated and dried if required before being directionally impelled and abraded. Further applied forces and guidance components distribute the materials to provide a curtain type flow pattern of directed movement that may be at least partially dependent on a primary fluid flow pattern. Materials moving in the directed curtain pattern are intercepted and, in effect, washed by a secondary or cross current flow of pressurized fluid that is of a sufficient density and velocity to loosen, suspend and differentially move dust constituents and the smallest particulate materials away from the curtain flow pattern while particles of larger size substantially continue to move in the original flow direction. The mineral values constituents are removed with the other dust materials from the cross current fluid carrier by filters. Multi-stage operation is contemplated, at each step of which the sand grain particle size is further reduced by the impact abrading step to free further mineral values materials.

In apparatus embodiments a horizontally disposed spinner impeller impacts the particles against circumferential wear plates as fan blades on the spinner direct air outwardly and downwardly to supplement first the abrading action and, secondly, the forces of gravity so the materials are caused to fall in the desired curtain pattern. The intercepting cross current fluid is provided by variable speed air blowers.

14 Claims, 4 Drawing Figures

ORE
CRUSHING
SIZING
DRYER

ORE BENEFICIATION METHOD AND APPARATUS

BACKGROUND OF THE INVENTION

In order to free minerals from the base materials with which the minerals are associated, many different processes have been devised and used. Usually ore processing involves crushing or grinding steps in order to reduce the particle size of the total material charge. The particle size reduction steps in both wet and dry ore beneficiation processes are in general intended to free the mineral values from the gangue materials so that a differential separation thereof can be accomplished. The present dry type ore processing method and apparatus is intended for use to free valuable minerals from sedimentary type deposits. Many ores of substantial value are, of course, found in sedimentary deposits or in common types of sedimentary materials. Due to the nature of such deposits, the minerals or values often do not occur in well defined locations or even in substantial concentration. Minerals of substantial value, such as uranium, vanadium, copper, gold and the like, can actually be widely dispersed in such sedimentary deposits. Since the minerals are of substantial value, areas and deposits where the minerals are concentrated have been extensively worked, and ores that are of adequate value to justify the expenses of mining, hauling and treatment have been removed and shipped to mill sites for treatment.

Under circumstances where the mineral values of ore deposits at a site are of varied concentration and parts of the deposit are uneconomic to haul to remote mills for processing, the deposits have been selectively mined, or low value materials that are removed have been sorted to avoid shipment of lower grade materials. Large dumps at the mine sites may, accordingly, contain substantial quantities of mineral, but it is generally still uneconomic to extract such low grade materials through use of on-site milling practices. At many mine sites the water necessary for wet mineral extraction processes is not even available. Accordingly, even portable types of wet ore processing equipment cannot be used.

Dumps containing uranium ores present a special problem, inasmuch as the radiation level at a dump site may be raised above prescribed environmental levels even though the percentage concentration of uranium in the material at the dump is still inadequate to justify the expenses of transportation and mill treatment.

The present invention is directed to the problems outlined, inasmuch as a method and apparatus is set forth which will permit processing of ores at remote mine site locations. Since a dry process is provided, dumps in arid regions at many remote locations can be processed. Likewise, ores that have been left in place due to previous costs of extraction, transportation and treatment can now be utilized, since practice of the present invention at the mine site provides a low treatment cost and a greatly reduced transportation burden. The present process and apparatus is especially adapted for use in the beneficiation of ores of the sedimentary type. In such deposits the mineral values are generally dispersed throughout gangue materials that are predominantly grains of sand. The minerals have been washed and silted into intimate contact with the grains of sand. A cementing material that may itself be of mineral origin holds the grains of sand and mineral together. Accordingly, the mineral values are essentially coated on the external surface of discrete grains of sand, and while the mineral may be tightly held in cracks and crevices on the surface of the individual sand grains, the mineral does not actually intrude into the sand or chemically combine therewith but remains separate therefrom. Efficient treatment of such ores requires reduction of the sandstone conglomerate to a particle size corresponding to the size of the individual sand grains and subsequent treatment of the total materials to dissolve, wipe, wash or otherwise remove the mineral ore and stains thereof from the exterior surface of the sand grain.

Usually the sand itself is not of commercial significance especially when located at a remote site, and, accordingly, the sand is generally considered to be the gangue material that is to be discarded. From a weight and bulk standpoint, it is this sand constituent that comprises the predominant portion of any deposit. Accordingly, if the mineral values alone or inclusive of the cementitious binder or slimes associated with the mineral values can be separated from the sand, the cost of transportation and haulage will be substantially reduced. Any on-site preliminary process that will separate the values from gangue materials is of further benefit, since the actual extraction of the mineral values from binder and carrier components at a flotation, chemical or other type processing mill will itself be improved by the mine site upgrading operations.

DESCRIPTION OF THE PREFERRED EMBODIMENTS

Figure 1:
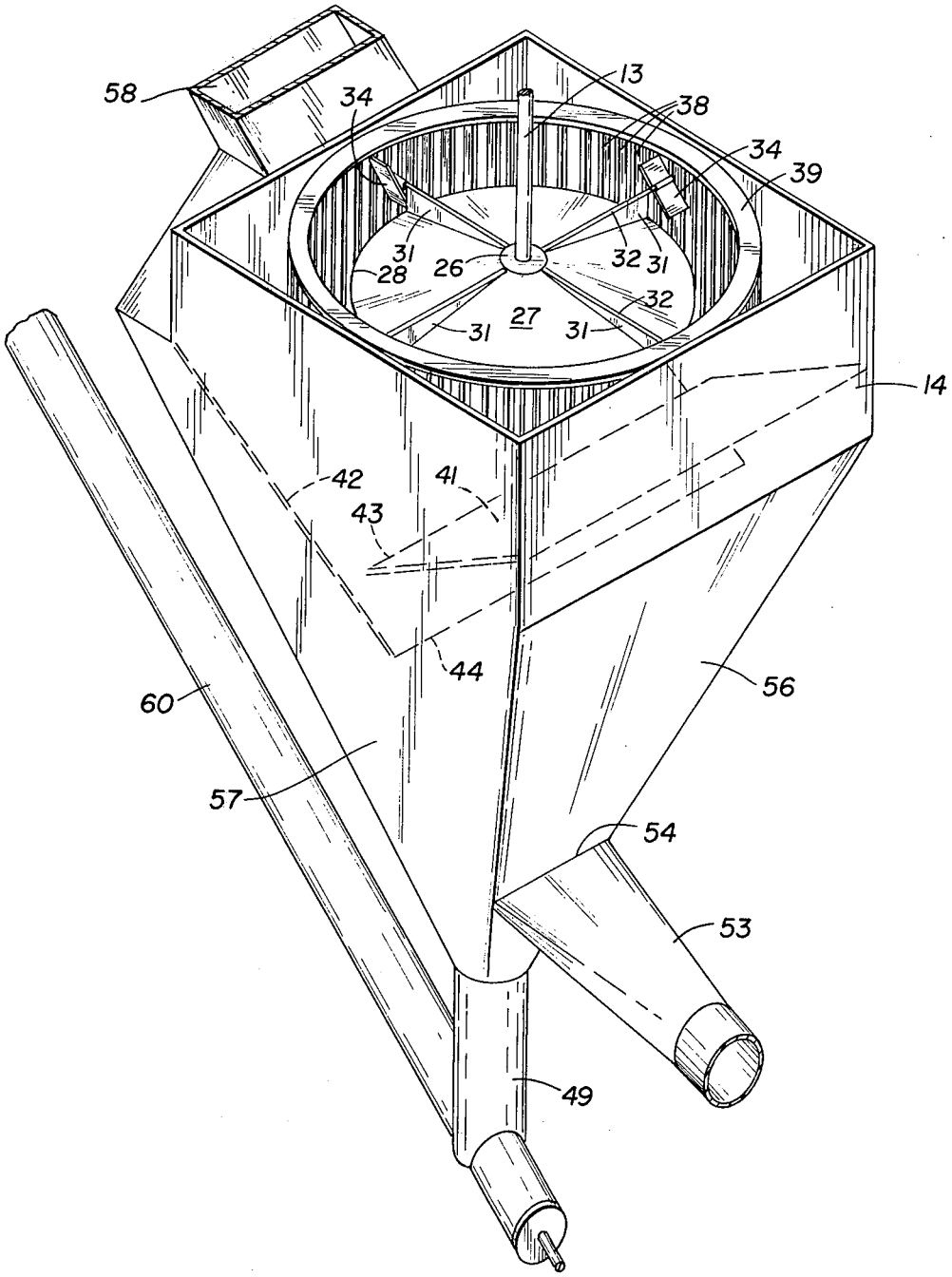
FIG. 1 is a perspective drawing showing features of one apparatus embodiment of the invention.

In the present dry process of separation of the mineral values from the sand particle gangue materials is obtained by subjecting the mineral bearing ore to a step process. The ore constituent, which may be of a sandstone type, is first crushed or ground to reduce the materials to a particle size that can be slightly greater than the predominant size of the sand particle constituents of the ore charge. Jaw or gyratory crushers or the like may be used to obtain an initial size reduction, and subsequently the ore can be subjected to additional crushing, grinding or roll processes until all of the materials to be treated are of a required initial size. For most sedimentary deposit ores, rod and ball mill type grinding will not be required or advantageous, since these units have a tendency to break up the sand grains themselves, and this type or reduction is not required or even desirable. Usually adequate size reduction can be obtained through use of roll or impact grinding apparatus that tends to separate the sand particles one from another instead of pulverizing such individual sand particles.

As the ore charge materials are being reduced in size, intermediate screening steps can be used together with materials recirculation to derive the desired particle size. Reduction of the ore charge to a particle size passing a ⅛ inch screen is usually adequate initial treatment for the first size reduction step of a successful process. After or before the materials are reduced to the desired initial particle size, the charge can be dried by subjecting it to a heating process. A rotary dryer where the materials are contacted by the flame is satisfactory. A drying step is not absolutely necessary for some ore deposits and might be eliminated for some ores or at some desert type locations where the moisture content of the material is already quite low. The drying step, however, can provide multiple benefits in connection with the present process. The object of subsequent steps of the process is to separate the mineral bearing constituent from the sand particles. If moisture is present, the adhesive forces binding the mineral bearing constituents to the sand particles will be increased. When the total charge is heated, the adhesive bond strength is, accordingly, decreased. Further, since the sand grains and the mineral bearing constituents will usually have different hygroscopic and heat conductance characteristics, the drying step can establish a less adherent interface between sand particle surfaces and the materials in contact therewith. Drying also materially improves the handling characteristics for both the values and gangue materials during subsequent steps of the process. Usually adequate results are obtained when the materials are heated to a temperature above the boiling point for water. Heat much in excess of 200° F. is generally not required. A practical heating range is from approximately 200° to 500° F. The total cycle time of the heating process is regulated in accordance with climatic conditions and the moisture content of the initial ore charge. The heating process need only be continued until all of the mineral inclusions, slimes and cementitious constituents of the ore charge are dried so that all such materials that ordinarily stain the grain particles can be wiped or shaken loose from the grain surface. If the initial sandstone binder materials include a substantial calcium content, the higher temperature ranges will be used in order to adequately dry the binder materials as well as the ore carrying constituents.

In keeping with the present process and method, the ore charge of materials of reduced size that is adequately dried is next subjected to a directional impelling force and abrading step so that the total materials are moved directionally into contact with wear plate elements while fluid forces tend to roll the particles along the wear plates and to subsequently reinforce a gravity oriented movement toward guide panels. The materials next cascade off of a guide panel edge in a curtain flow pattern of guided movement wherein individual particles are generally separated and dispersed.

In the next step of the process, air or other fluid is introduced along a secondary or cross-current flow path that intercepts the established movement pattern for the separate particles. The cross-current fluid has a substantial velocity as it is delivered against the surfaces of the individual particles. Such impingement essentially washes the surfaces of the separate particles with which the secondary fluid collides. At the point of interception the directed momentum of the particulate materials should be adequate so that the cross-current impinged fluid does not radically change the direction of movement for at least the larger sized particles. Conversely, the slimes and cementitious materials which are of smaller particle size than the carrier grains of sand are blown loose from the sand particles to be moved and carried by the secondary fluid stream along a new course and direction that is divergent with respect to the initial curtain flow pattern.

The materials entrained by the secondary flow that may be inclusive of small dust size particles of the original sand are next moved to a dry filter stage where all of the solid materials are collected and removed from the carrier fluid or air. The carrier fluid or air is either discharged to the atmosphere or it can be returned for reintroduction as the secondary or intercepting fluid. The materials that are essentially blown loose from the carrier particles of sand will include the desired mineral values. When filtered, this product, of course, contains substantial quantities of materials other than the desired minerals, but this derived product could still be termed a "dust values product". The sand constituents and other particles of larger size continue to move in the initial curtain flow pattern direction to a point of separate collection as the "residual" minerals from a first cyclic operation.

Usually the total mineral values in any ore charge will not be removed if only a single cross-current blow separation cycle is utilized. Accordingly, while the dust values product from a first cycle is collected as a sale product, the residual sand particulate materials that may have been treated as described in the first cycle may still contain or entrain a substantial quantity of mineral values. For most operations these residual particulate materials are, accordingly, collected for delivery and treatment in successive operational cycles.

In order to increase the efficiency of subsequent treatment cycles, it has been found advantageous to subject the residual materials from a first or later cycle to a subsequent crushing or abrading action that further reduces the overall particle size in order to expose new sand grain surfaces before repetition of the secondary cross-current flow separation step. Subsequent treatment cycles, accordingly, preferably include step processes similar to those used in the first cycle. The cycles and step processes are preferably continued until even the small size grain particles have been freed and abraded and the face surfaces of such smaller grain particles have been contacted and subjected to the washing action provided by the secondary and intercepting fluid flow. The dust values product from each cycle is collected to provide the sale product. Such dust values product retained at the filters are of substantially reduced bulk and weight when compared to the total ore charge. This sale product is accordingly more readily and economically transported to a mill where the sale materials can usually be directly introduced into various ore separating processes without further grinding or sizing operations. Since the dust value products are already substantially concentrated, the efficiency and economy of flotation and/or chemical treatment is substantially improved, and an overall economic advantage is obtained.

The described method, accordingly, provides a separation of materials that is operationally dependent on the forces that act on each separate particle of material. At the point of differential separation a new and cross-current force is introduced that has the capability of moving particles of the smallest size in a changed direction while particles of larger size continue substantially along the initial course. Since the process is dependent upon the forces directed on each separate particle irrespective of size, it is important that the materials are dispersed in thin sheet or curtain pattern so that contact between the particles and the intercepting force medium is assured. In the present dry process type of separation, the fluid carrier medium for at least the intercepting cross-current flow will preferably be of a gas type and in most all instances will simply be a directed stream of air. Forces of gravity will probably in all instances be a significant factor in connection with the determination of the respective initial and secondary movement directions. It is quite possible, however, that the movement characteristics dependent on gravitational forces may be overcome, minimized or even more beneficially used under circumstances where the impelling force that establishes the initial path for directional movement through the separation zone is greater than the force of gravity.

Where a gaseous fluid is used, the buoyancy of the carrier fluid as distinguished from its carrying power will usually not be significant. Essentially, the desired separation is dependent then on the respective carrying power of the entraining and intercepting fluid flows. The carrying power of gaseous fluid streams, or even of liquid streams, is primarily a function of the velocity of flow and the size of particles to be carried by the stream. Even the respective densities of separate materials to be carried is not as significant as the particle size of such materials when the carrying power of a stream of established velocity is considered.

While both the size and the density of particles are important factors in connection with the transportation power of fluid streams, the size of particles that will be carried varies approximately as the square of the velocity while the weight or density of substances that will be carried varies as about the sixth power of the velocity. In the present instance where mineral values are to be separated from sand type gangue materials, the differences in the respective densities are not too widespread. Vanadium-uranium type ores might have specific gravities in a range from 3.0 to 4.5, while the sandstone itself might have a specific gravity around 2.3. On the other hand, the sand grains in the sandstone have characteristic particle sizes that are considerably larger than the particle sizes for the treated cementitious material, slimes and mineral values constituents originally interspersed in the sandstone.

If the size reduction functions of the method are continued only until the sand grains are separated and the surfaces of such sand grains are abraded and subsequently subjected to the washing action provided by the impinging secondary or cross-current flow, the particles of the so-called mineral dust values product will be carried divergently away from the movement pattern for the larger sand particles when the intercepting carrier stream is of a velocity to suspend and transport the small particles but not of great enough velocity to carry and divergently move the still larger sand grain particles. If properly operated, the natural differences in particle size relationship assures removal of the dust values product from the predominant bulk and weight of the sand or gangue material constituents. Necessarily, some sand particles of minor size that have been chipped or abraded from original sand grains will be present in the dust values product, but the overall weight and bulk of the sale product that must be transported to a mill is significantly reduced.

In practice of the method of optimum recovery of values is obtained when a multiple cycle process is used where each cycle is inclusive of separate impact-abrasion, dispersed movement pattern, and intercepting secondary flow steps. The cycles are repeated until the particle size for the sand constituents approximates the size of the smaller sand grain particles in the original sandstone. Importantly, the impact-abrasion step is intended to provide the desired size reduction without grinding and smashing the individual sand grains. When properly controlled, this successively repeated step, however, does significantly abrade the sand particles. It is found that a maximum mineral recovery is obtained when the usually sharp corners of the individual sand particles have actually been rounded by such abrading action. If the corners are rounded, the face surfaces will have been wiped one against the other, and all mineral stains on the face surfaces and even in most crevices of the sand grain particles will be removed. After passing through multiple cycles, the reject or residual sand related gangue materials are of near uniform particle size and of quicksand type characteristic.

Figures 3, 4:
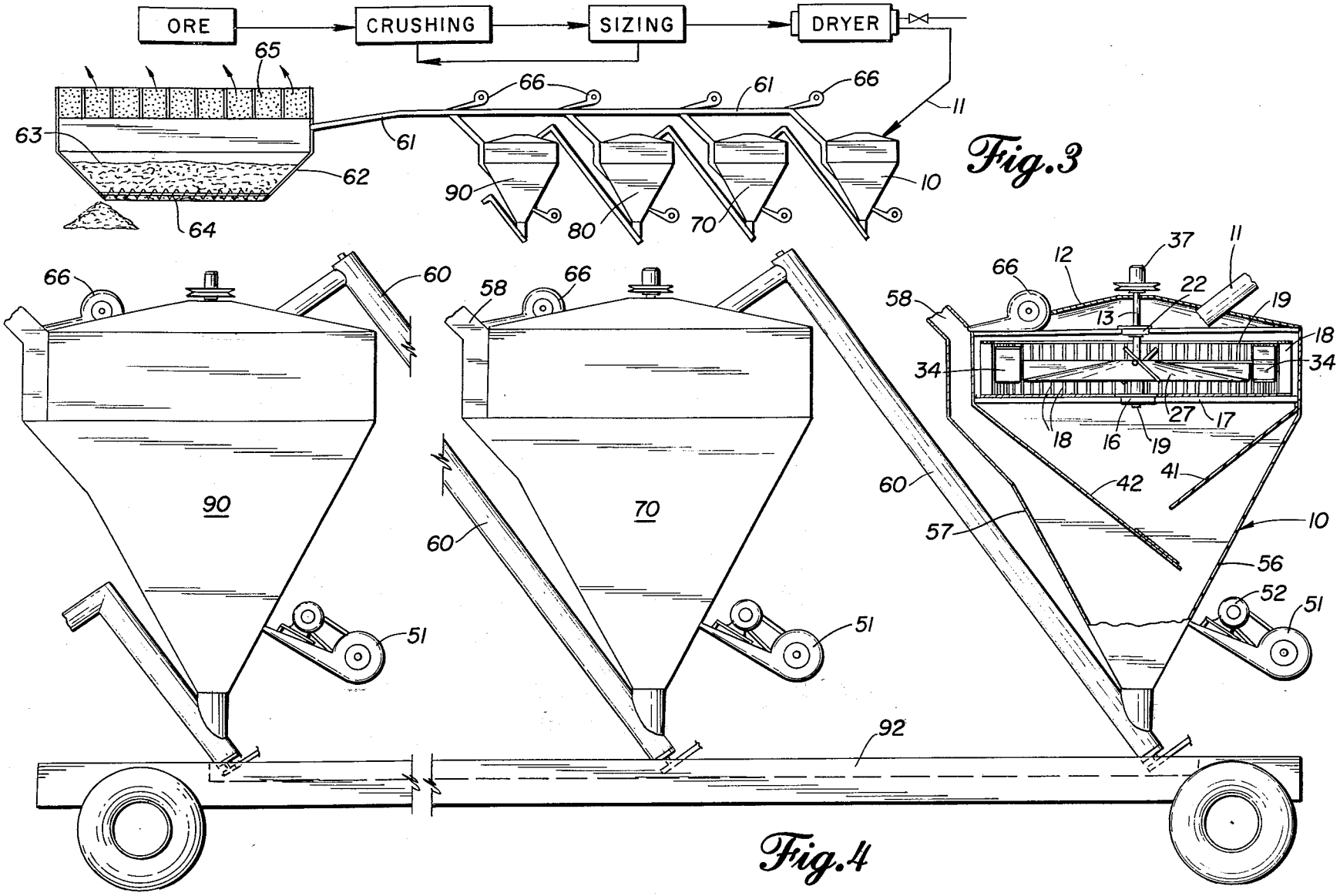
FIG. 3 is a circuit diagram illustrative of apparatus and method used in keeping with the invention, and, FIG. 4 is a side elevation showing a battery arrangement of ore processing machines.

One apparatus embodiment of the invention which beneficially meets the requirements of the present method is shown in the accompanying drawings, in FIG. 3 of which a total cyclic process is schematically shown. In the practice of such process the grinder-separator components shown in all of the Figures may be beneficially used.

Where uranium ores are being processed, a plurality of grinder-separator cells are used. The grinder-separators 10, 70, 80 and 90 as shown in FIG. 3 are positioned to receive a crushed and sized ore product that has been passed through a rotary dryer. The underfeed sand particles that fall to the bottom of the first cell 10 after completion of a first cycle are delivered for retreatment to a second cell 70. Subsequent underfeed products are delivered successively in repeat cyclic arrangement to the additional cells 80 and 90 disposed in downstream circuit arrangement. The dust values extracted from the first cell 10 and all subsequent cells are all delivered by carrier duct 61 to a filter unit 62. The enclosure of the filter unit 62 receives the dust laden air or other fluid. Dust materials 63 which settle to the bottom of the filter unit 62 are removed therefrom by an auger conveyor 64 to a discharge pile or to a collector hopper. From such discharge pile or hopper these sale product materials are loaded for shipment to a mill for further separation and treatment. The secondary carrier fluid or air is itself passed through a plurality of filter panels 65 to the atmosphere, while the dust separated by the filters collects on the interior surface thereof and is periodically dropped to the filter unit auger 64.

Figure 2:
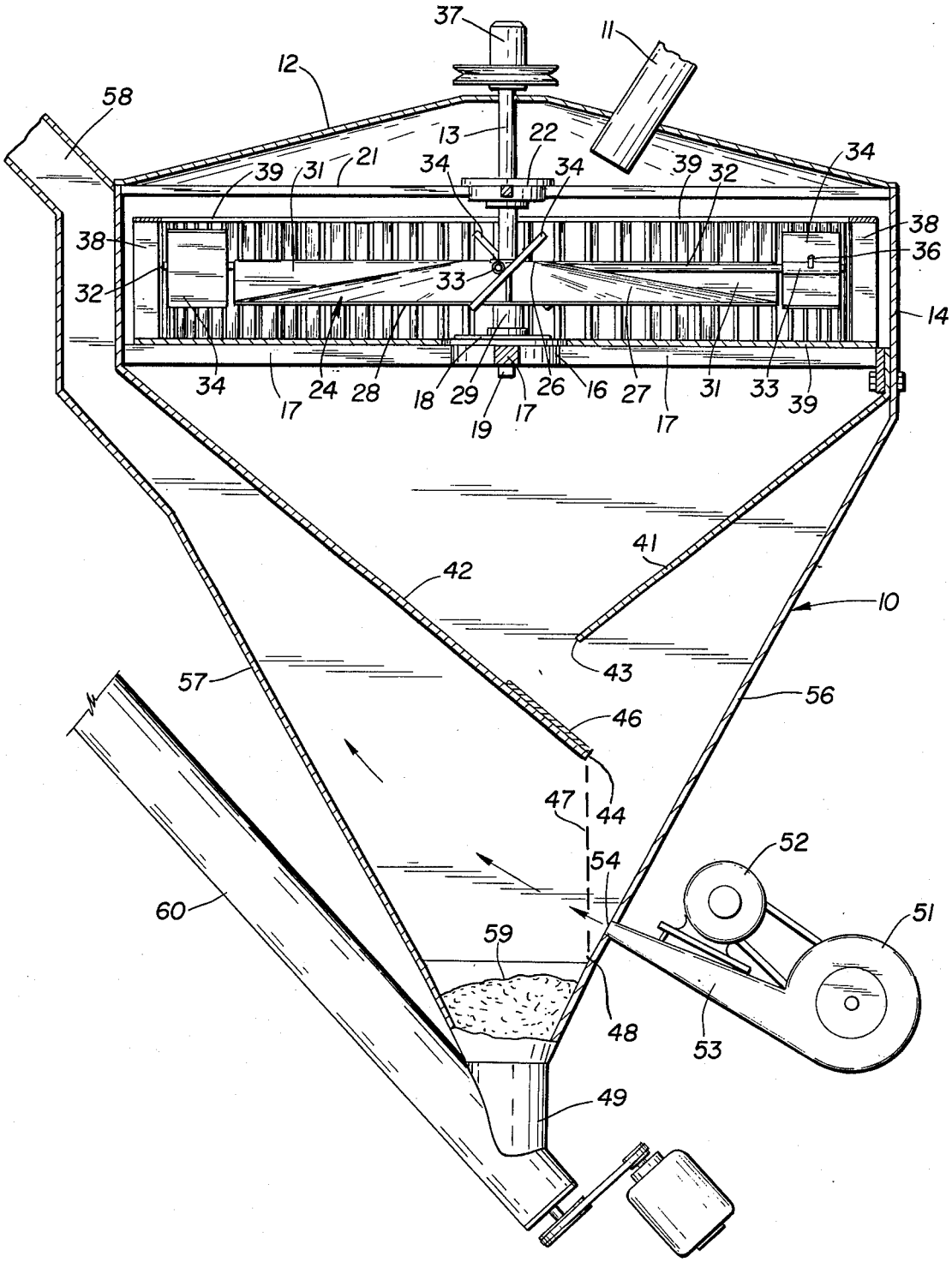
FIG. 2 is a cross-sectional elevation with parts in section showing further features of such apparatus.

The ore materials are subjected at each of the separate cells 10, 70, 80 and 90 to a similar treatment cycle that can best be described in connection with the presentations in FIGS. 1, 2 and 4. The ore materials received from the dryer are delivered to the upper center of the first cell 10 by an auger to feed chute 11. The materials are introduced into the first cell 10 through a cover enclosure 12 that primarily prevents the escape of air and dust from the cell but which can additionally provide support for a main drive shaft 13. The drive shaft 13 extends downwardly into the upper or receiving end 14 of the cell 10. An open web support 16 having a plurality of radially disposed arms 17 provides support for a central bearing 18 that receives and provides rotating support for the lower end 19 of the main drive shaft 13. A similar open web support 21 receives and holds a top bearing 22 that likewise supports the drive shaft 13. The chute 11 is positioned to deposit the ore charge materials near the center of a rotating dished impeller 24 that is mounted for rotation with the drive shaft 13. Preferably the point of discharge for the ore materials is away from the top bearing 22 and may correspond with the position of a central flat section 26 of the frustro-conically shaped top surface 27 of the impeller 24. This top surface of the impeller supports the ore charged materials as they are moved downwardly and outwardly by action of the impeller. A lower circular disk section 28 is joined to the shaped top surface 27, and both surfaces are joined to a central collar 29 which surrounds and is engaged to the main drive shaft 13. A plurality of radially disposed vanes 31 that are of tapered triangular shape extend outwardly from the hub or collar 29 in position above the shaped top surface 27. Support shafts 32 are joined to the back surfaces of the vanes 31. These shafts extend outwardly past the ends of the vanes 31 and are adapted to receive sleeves 33 that are attached to blade elements 34. Set screws 36 are provided so that the angular position of the blades 34 may be adjusted with respect to the supporting shafts 32.

A variable speed drive pulley 37 is provided on the upper end of the drive shaft 13 at a position above the cover 12. A drive motor and belt drive (not shown) is connected to the variable speed drive pulley 37 so that the shafts 13 may be rotated within the entrance sections 14 of the cells 10 through 90 at speeds that may be regulated by adjustments of the variable speed drive pulleys 37. For a cell in which the entrance section 14 is approximately four foot square, the components which rotate the main drive shaft 13 are capable of inducing shaft speeds of 450 to 900 RPM. At such speeds and with operational dimensions commensurate with the foregoing description and in keeping with the drawings, it is obvious that the ore materials of an already reduced size dumped on the center of the impeller will be forcefully moved and impelled outwardly by action of the impeller 24 and the drive vanes 31 disposed thereon. Ore particles of reduced size will by such action be thrown outwardly toward the walls of the inlet section 14 of the cell 10. The actual movement pattern of the impelled particles, however, will be intercepted by the cylindrically disposed individual wear plates 38 of an impact wear ring 39. Such wear ring is preferably made up of a plurality of separate wear plates 38 that are held in side-by-side circumferentially disposed relation by separate bolts or fasteners (not shown). The total wear ring will be supported in the entrance section of the cell 10 by the open web support 16 or by additional structural components joined to the cell structure. Desirably the individual wear plates 38 should be separately removable so that the entire wear ring assembly can be replaced, since even abrasion resistant materials will be worn away by the action of the granular particles of ore directed thereagainst by action of the impeller 24. Necessarily, when the individual particles of ore are impacted against the wear ring 39, some particles will be broken and all the materials will be abraded.

While a type of impact grinding is attained by such action, it is desirable that the rotational speed of the impeller and other flow control components be regulated so that only a minor overall size reduction is obtained in any single cell. Desirably, ore particles that are of greater size than the size of the individual sand grains will be broken down in the course of treatment in multiple cells to an eventual particle size that corresponds with the predominant size for individual sand grains making up the initial sandstone or ore charge. In operation of the device it has been noted that best results are obtained when the total action of the particulate charge is one of impact separation with an accompanying relatively mild abrading of the old and new surfaces derived from such impact separation. For sandstone type uranium ores an impeller rotational speed that would tend to throw one-eighth inch sized particles outwardly a distance of fifty feet or more if not intercepted by the wear ring has been found to be satisfactory. Ores in which the sand or other natural gangue material particles are harder would require greater impact velocities, and, accordingly, rotational speeds in the higher range would be required. With uranium ores from the Morrison or Shinarump formations, rotational speed in the 600 to 700 RPM range has been found to be satisfactory.

Movement patterns for the particles are not derived solely from action of the impeller 24 and its vanes 31. The fan blades 34 are disposed in an intercepting position with respect to a normal movement pattern for a substantial portion of the outwardly discharged particles. Accordingly, impact against such blades can also cause a certain proportion of the particle size reduction result. In the illustrations of FIG. 2 the blades 34 are shown at an angular position approximately 45°. With this particular angle of disposition and a high input RPM for the drive shaft 13, a substantial outwardly and downwardly directed air flow will be established. The movement pattern for the air introduced and pumped by the blades 34 can modify the movement pattern for the outwardly impelled ore particles. The outwardly directed component of the air flow pattern serves to hold individual particles in contact with the wear plates and to, in effect, roll such particles along the constrained cylindrical surface of the wear ring. This action assures efficient contact and abrading of the grain particle surfaces. Gravitational forces are supplemented by the downwardly directed component of the air flow pattern derived from the angularly disposed blades 34 to cause particles that have been impacted and rolled against the wear ring to move downwardly past the lower support 17. The falling and/or air-carried impelled ore particles are intercepted in the lower section of the cell 10 by angularly disposed guide panels 41 and 42. Materials falling on the panel 41 course downwardly along the top surface thereof and subsequently fall off of a lower free end 43 to be received on the lower end of the guide panel 42. Panels 41 and 42 are disposed at a substantial angle of inclination, and, accordingly, the loose materials of reduced particle size move freely down along the upper surfaces of such panels. Such movement pattern is, of course, reinforced by the downwardly directed air flow from the blades 34 and also by vibration influences inherent in the construction and operation of the cell. All of the materials are eventually discharged off the free edge 44 of the panel 42. Since the panels 41 and 42 extend across the full width of the lower section of the cell 10, the lower lip 44 is of substantial longitudinal length. Though vibration and air flow patterns tend to spread the particulate materials along the width of the panels, an even distribution of materials along the edge or lip 44 is desirable. Accordingly, guide elements or riffles 46 can be disposed on the top surface of the panel 42 in order to assure an even distribution of materials along the length of the edge 44. If an even distribution is obtained, all of the materials introduced into the cell will have a tendency to cascade off of the free edge 44 providing a regular and even distribution. A curtain pattern of falling materials is thus derived that is generally disposed along a falling flow line 47 as indicated by the dotted line representation in FIG. 2. The curtain of such materials would ordinarily fall to be collected along a line in the position indicated by the numeral 48 adjacent the lower discharge 49 for the cell 10.

The desired separation between the carrier or gangue materials and any ore bearing dirt or cementitious material inclusions is accomplished as the materials fall in a primary course along the curtain pattern fall line 47. An air blower 51 driven by the motor 52 and having a variable speed drive capability is disposed so that air introduced into the blower is discharged through a transition section 53 at an increased pressure and velocity through an elongated nozzle opening 54. The nozzle opening 54 extends across the full width of a front sheet 56 of the lower cell structure. The nozzle 54 is also disposed so that the air emitted therefrom intercepts the primary movement pattern for the curtain of materials moving downwardly along the fall line 47. A secondary and intercepting air flow is directed against the falling curtain of materials 47 to blow and, in effect, wash past the falling sand particles to free dust particles of smaller size that are entrained with the grains of sand. The positioning of the secondary or intercepting flow and the velocity thereof is preferably regulated so that fine dust materials will be carried backwardly toward contact with a back panel 57 of the lower cell structure. The velocity of the secondary air flow should be adequate to support and entrain the minor sized dust particles and to at least start movement of such particles up the inner surface of the back panel 57 for delivery toward an upper discharge opening 58 disposed adjacent the top of the cell 10. The velocity of the secondary flow should further be regulated so that any larger particles that may be initially diverted by the secondary flow will not be carried and will fall downwardly to be collected in a pile 59 disposed in the outlet or bottom end for the cell. The collected pile of material 59 in effect provides an air stop preventing loss of any of the air in the cell out of the bottom discharge 49. Accordingly, all of the air introduced into the cell by action either of the fan blades 34 or through use of the blower 51 must pass out of the upper discharge opening 58. With this arrangement the air introduced by the fan blades 34 itself has a discharge flow pattern which acts to supplement the upwardly directed movement pattern for dust particles separated from the initial dispersed curtain flow pattern. The forced draft provided by the fan blades 34 and blower 51 together should provide an air velocity that is adequate to suspend, carry and move minor sized dust particles upwardly and out of the upper discharge opening 58. In order to insure and further to maintain the desired carrying capacity, however, an induced draft fan 66 is positioned for connection in the main carrier duct 61 adjacent to the points of connection for the upper discharge openings 58 and such main carrier duct. A plurality of induced draft fans 66 may be used as illustrated in FIG. 3. If these induced draft fans 66 have a variable speed capability, the flow of dust materials up and out of each cell and through the carrier duct 61 can be closely regulated. Since all of the dust values materials thus separated in each of the cells and all of the air from all of the cells is delivered to the filter unit 62, the escape of dust into the atmosphere is prevented. In order to minimize dust contamination of the atmosphere, the speed and delivery of the separate augers 60 should be similarly regulable so that sand related residue materials will always be present in the separate piles 59 or at least within the augers themselves, and dust laden air will not move from one cell to the next succeeding cell through the auger connections.

Materials collected at the bottom of the separate cells in the separate piles 59 are in effect an underfeed material for that particular cell or cycle of the total process arrangement. Such underfeed materials from the first cycle or cell 10 are received in elevating auger 60 to be carried upwardly for discharge downwardly at the center of the next succeeding cell 70. The processing of materials in the second cycle carried on within the cell 70 is similar to that already described. The underfeed materials from the first cycle are again accelerated and impelled against wear plates to effect a further impact separation of grain particles and to abrade the surfaces of all the grain particles as necessary to free the dust values materials from the sand grain particles. Again the initial curtain flow movement pattern is intercepted by a secondary flow that is of strength and carry only the dust particles of minor size. The separated dust particles are again carried upwardly to a discharge opening 58 and to the main carrier duct 61. Such cyclic processes are continued in successive cells until all of the original sandstone ore charge is reduced to a particle size corresponding to the smaller size range for discrete sand particles making up the initial sandstone.

The underfeed sand particles removed from the last cell will have been substantially worked, and only minor mineral stains and mineral will be present. In general, the corners of all such sand particles will be rounded, and, accordingly, this underfeed discharge is quite similar to a relatively fine quicksand. The discharged residue itself could be quite satisfactory for many sand type uses, but it probably will not be a significant commercial item due mainly to its remote location away from points of potential use. The uranium, and its radioactive content, however, will be substantially removed with the dust values extract, and, accordingly, any residual piles of sand left over after practice of the invention will not have an excessive radioactive reading. The sand can without detriment to the environment be left in place after all apparatus, inclusive of the cells mounted on a trailer unit 92, are moved to a new site.

The dust values materials removed through practice of the described four-cycle process will include approximately 90 percent of all minerals in the original charge in a considerably concentrated form. These dust materials can be more economically transported to mills where the minerals will be conventionally separated from the cementitious materials and slimes constituents. Since all of the dust materials will already be of relatively small size, these fines can ordinarily be introduced into flotation separation processes without further grinding or classification. Mill site costs and charges should, accordingly, be reduced through practice of this invention.

While the method and apparatus can be used for the separation of other mineral values from sedimentary type deposits (such as copper from Malachite and Azurite) or for the separation of gold, platinum, silver and the like from placer sands, the foregoing process and apparatus is of special benefit when used in connection with the treatment of uranium bearing ores. The sandstones of the Western states in the Shinarump and Morrison formations which contain uranium values also usually contain vanadium. The uranium and vanadium values and any other associated minerals are separated from the host sands through practice of this invention. Previous mining and milling practices with respect to the handling, purchase and sale of uranium has contributed to the economic and environmental benefits to be derived from use of this invention. Among pertinent factors are the following: Milling of uranium is licensed and controlled by the Atomic Energy Commission. The number of mills is rather limited, and existing mills for the treatment of uranium ores are not always convenient to mine sites that produce or have produced uranium ores. The mills are in general controlled by companies that have previously established purchasing policies that have precluded the outside purchase and treatment of the lower grade ores from individual mine operators. Ores that did not have the required uranium and vanadium content were not received and purchased by the contract mill operators, even though substantial quantities of low grade ores of the same low mineral content that belonged to the contract mill operators were processed. Accordingly, many of the small mine operators were forced to hand-sort their mined product in order to make certain that the ores transported to the mills would have the requisite uranium content. The materials that were thus rejected and dumped at the mine site might still have a uranium content that would justify milling and extraction. The concentration of radioactive materials at some mine dump sites is great enough to cause environmental problems adjacent to such sites. The radiation hazard at many dump sites greatly exceeds allowable limits established by both the Atomic Energy Commission and by the Environmental Protection Agencies of the government. In view of such factors and with the present increased awareness of the environment, it is obvious that some processing of the old mine dumps is now required. The covering of such dumps with non-radioactive soil has been sugggested by environmentalists, but this is not an optimum solution for the problem since the uranium values which provide the source of the undesirable radioactivity at dump sites is still a valuable resource that should be recovered if possible. The apparatus and method described makes such recovery possible, and at many dump sites the process could be beneficially used at a profit.

I claim:

1. A method for the beneficiation of sedimentary type ores wherein the gangue materials have a characteristic grain size that is larger than the particle size for values constituents of the ore and harder than said values constituents comprising crushing and sizing the total ore charge until all materials are of a size corresponding to the largest particle grain size for said gangue materials, further reducing the size of the largest particles of the charge in an impact-abrasion zone by introducing forces assuring impacting contact between the charged ore particles and reaction elements in said zone, introducing an initial fluid flow directed through said impact-abrasion zone to carry the materials and fluid away from said zone, interposing guide elements at positions away from said zone in the directed flow path from said zone to intercept and divert said materials and initial fluid whereby the materials are spread and distributed as they pass said guide element to provide a curtain type flow pattern moving away from said guide elements in a primary direction, and subsequently introducing a secondary cross-current fluid input that intercepts the movement pattern for said materials and initial fluid while moving along said primary direction, said secondary cross-current fluid input being of regulable intensity whereby materials of the smaller particle size are separated from said primary direction movement pattern and are entrained for movement along a secondary flow path as energized by said secondary fluid flow.

2. The method as set forth in claim 1 wherein the charged ore particles are impelled against stationary reaction elements in said zone.

3. The method as set forth in claim 2 wherein said reaction elements are disposed circumferentially to define said zone.

4. The method as set forth in claim 2 wherein said initial fluid flow through said impact-abrasion zone is derived from the same components providing the particles impelling force.

5. The method as set forth in claim 4 wherein said impact-abrasion zone is horizontally disposed, and the ore particles are impelled radially and horizontally against said reaction elements.

6. The method as set forth in claim 5 wherein the initial fluid flow through said zone is directed downwardly, and the primary movement pattern for said materials and fluid is accordingly aided by forces of gravity.

7. The method as set forth in claim 1 wherein the said primary direction for said curtain type flow pattern of materials and fluid is downwardly directed, and said curtain flow pattern is aided by forces of gravity.

8. The method as set forth in claim 7 wherein said secondary cross-current fluid input is disposed transversely to the primary direction for said curtain type flow pattern and wherein the forces exerted by said secondary cross-current fluid input must accordingly be of sufficient magnitude to overcome momentum and gravitational forces acting on the smaller material particles.

9. The method as set forth in claim 1 wherein a dry process is provided and further comprising the additional step of heating the total ore charge before the materials are introduced into said impact-abrasion zone.

10. The method as set forth in claim 1 wherein a plurality of cell components are used in interconnected circuit arrangement with each cell separately providing the treatment steps as set forth.

11. The method as set forth in claim 10 wherein the materials of smaller particle size separated by the secondary cross-current fluid input are collected in common to provide the values discharge of said method.

12. The method as set forth in claim 10 and further comprising the additional step of filtering the materials of smaller particle size from said secondary cross-current fluid to obtain the values discharge of said method.

13. The method as set forth in claim 1 wherein a dry process is provided and said initial fluid and secondary cross-current fluid are gaseous.

14. The method as set forth in claim 13 wherein said initial fluid and secondary cross-current fluid are air.

* * * * *